US005984792A

United States Patent [19]

Clark

[11] Patent Number: 5,984,792

[45] Date of Patent: Nov. 16, 1999

[54] BUNGEE SWING

[76] Inventor: Rodney Clark, 496 N. 2000 West, West Point, Utah 84015

[21] Appl. No.: 09/156,119

[22] Filed: Sep. 17, 1998

[51] Int. Cl.[6] ..... A63G 9/14

[52] U.S. Cl. ..... 472/118; 472/120

[58] Field of Search ..... 472/118, 120, 472/124, 135, 14; 297/423.1, 423.19

[56] References Cited

U.S. PATENT DOCUMENTS

| | | | |
|---|---|---|---|
| 424,329 | 3/1890 | Messmore | 297/423.1 |
| 719,301 | 1/1903 | Campbell | 297/423.1 |
| 1,490,619 | 4/1924 | Manikowske et al. | 472/124 |
| 1,838,482 | 12/1931 | Hartman | 472/124 |
| 3,897,056 | 7/1975 | Hock et al. | 472/118 |
| 4,289,310 | 9/1981 | Weakly | 472/118 |
| 5,364,312 | 11/1994 | Cunard et al. | 472/118 |

*Primary Examiner*—Kien T. Nguyen

[57] ABSTRACT

A new bungee swing for providing swinging and bouncing motions. The inventive device includes a flexible seat. A pair of bungee cords each have lower ends coupled with respect to the flexible seat and upper ends coupled with respect to an elevated overhang.

8 Claims, 2 Drawing Sheets

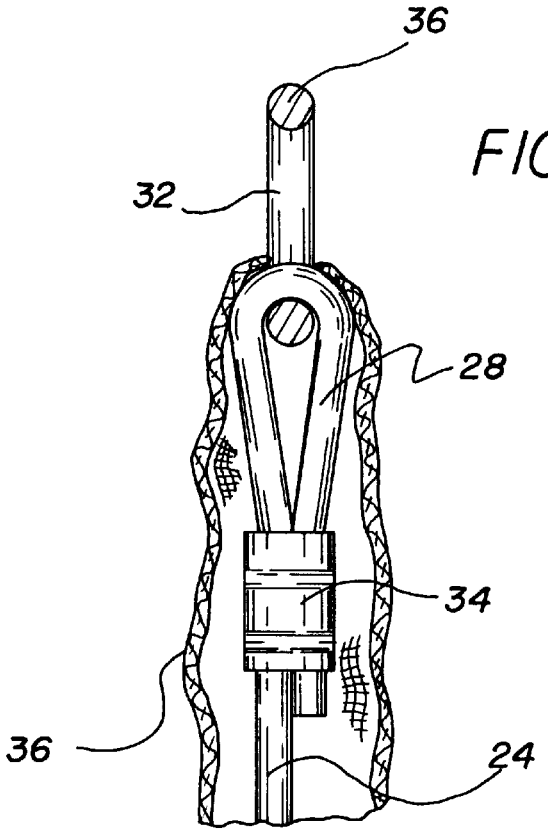
FIG.3
FIG.4
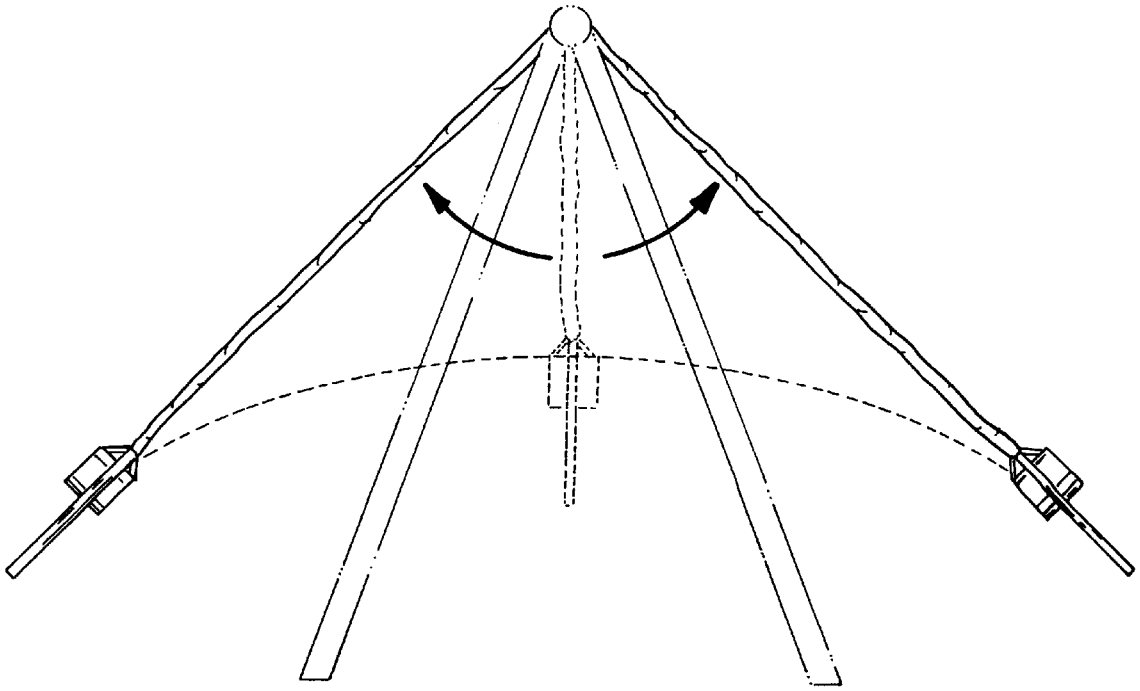

BUNGEE SWING

BACKGROUND OF THE INVENTION

Field of the Invention

The present invention relates to swings and more particularly pertains to a new bungee swing for providing swinging and bouncing motions.

Description of the Prior Art

The use of swings is known in the prior art. More specifically, swings heretofore devised and utilized are known to consist basically of familiar, expected and obvious structural configurations, notwithstanding the myriad of designs encompassed by the crowded prior art which have been developed for the fulfillment of countless objectives and requirements.

Known prior art swings include U.S. Pat. No. 5,342,245 to Webb, Jr.; U.S. Pat. No. 4,296,923 to Ahrens; U.S. Pat. No. Des. 361,117 to Leek; U.S. Pat. No. 5,427,575 to Berk; U.S. Pat. No. 5,240,460 to Tighe; and U.S. Pat. No. 4,084,812 to Melrose et al.

While these devices fulfill their respective, particular objectives and requirements, the aforementioned patents do not disclose a new bungee swing. The inventive device includes a flexible seat. A pair of bungee cords each have lower ends coupled with respect to the flexible seat and upper ends coupled with respect to an elevated overhang.

In these respects, the bungee swing according to the present invention substantially departs from the conventional concepts and designs of the prior art, and in so doing provides an apparatus primarily developed for the providing swinging and bouncing motions of providing swinging and bouncing motions.

SUMMARY OF THE INVENTION

In view of the foregoing disadvantages inherent in the known types of swings now present in the prior art, the present invention provides a new bungee swing construction wherein the same can be utilized for providing swinging and bouncing motions.

The general providing swinging and bouncing motions of the present invention, which will be described subsequently in greater detail, is to provide a new bungee swing apparatus and method which has many of the advantages of the swings mentioned heretofore and many novel features that result in a new bungee swing which is not anticipated, rendered obvious, suggested, or even implied by any of the prior art swings, either alone or in any combination thereof.

To attain this, the present invention generally comprises a flexible seat having a generally rectangular configuration. The seat has planar upper and lower surfaces. The seat has opposed long edges and opposed short edges. The opposed short edges each have securement straps secured thereto. A foot strap is coupled with respect to the flexible seat. The foot strap has an elongated and generally thin configuration. Opposed ends of the foot strap terminate in loops. The loops couple with the securement straps of the flexible seat. A pair of bungee cords each have lower ends coupled with respect to the flexible seat and upper ends coupled with respect to an upper horizontal bar of a swing set. The lower ends are secured to the securement straps of the flexible seat. The upper ends extend through a connecting link and are bent back against the cord and are coupled thereto by a crimping swedge. The connecting link has an upper section adapted for coupling with the upper horizontal bar of the swing set. Each of the bungee cords has a cloth casing disposed thereover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the providing swinging and bouncing motions of description and should not be regarded as limiting.

As such, those skilled in the art will appreciate that the conception, upon which this disclosure is based, may readily be utilized as a basis for the designing of other structures, methods and systems for carrying out the several providing swinging and bouncing motions of the present invention. It is important, therefore, that the claims be regarded as including such equivalent constructions insofar as they do not depart from the spirit and scope of the present invention.

Further, the providing swinging and bouncing motions of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new bungee swing apparatus and method which has many of the advantages of the swings mentioned heretofore and many novel features that result in a new bungee swing which is not anticipated, rendered obvious, suggested, or even implied by any of the prior art swings, either alone or in any combination thereof.

It is another object of the present invention to provide a new bungee swing which may be easily and efficiently manufactured and marketed.

It is a further object of the present invention to provide a new bungee swing which is of a durable and reliable construction.

An even further object of the present invention is to provide a new bungee swing which is susceptible of a low cost of manufacture with regard to both materials and labor, and which accordingly is then susceptible of low prices of sale to the consuming public, thereby making such bungee swing economically available to the buying public.

Still yet another object of the present invention is to provide a new bungee swing which provides in the apparatuses and methods of the prior art some of the advantages thereof, while simultaneously overcoming some of the disadvantages normally associated therewith.

Still another object of the present invention is to provide a new bungee swing for providing swinging and bouncing motions.

Yet another object of the present invention is to provide a new bungee swing which includes a flexible seat. A pair of bungee cords each have lower ends coupled with respect to the flexible seat and upper ends coupled with respect to an elevated overhang.

Still yet another object of the present invention is to provide a new bungee swing that encourages physical activity and imaginative playtime.

Even still another object of the present invention is to provide a new bungee swing that provides entertaining physical activity and exercise for young children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 1.

FIG. 4 is a side view of the present invention illustrated in use.

DESCRIPTION OF THE PREFERRED EMBODIMENT

Figure 1:
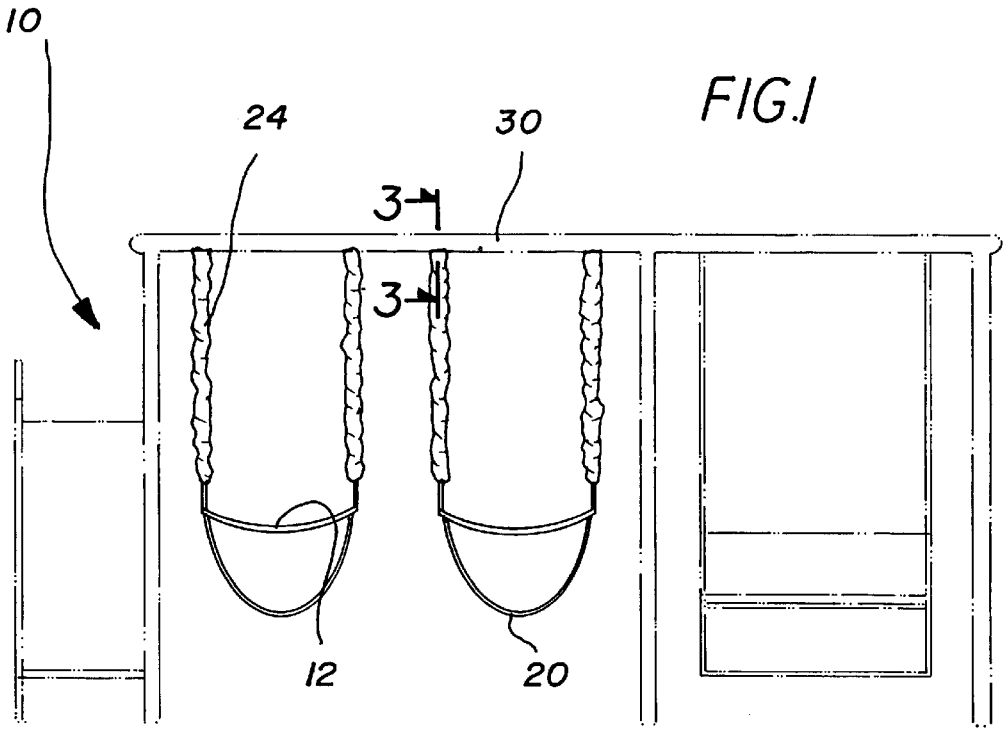
FIG. 1 is a front view of a new bungee swing according to the present invention as coupled to an existing swing set.
Figure 2:
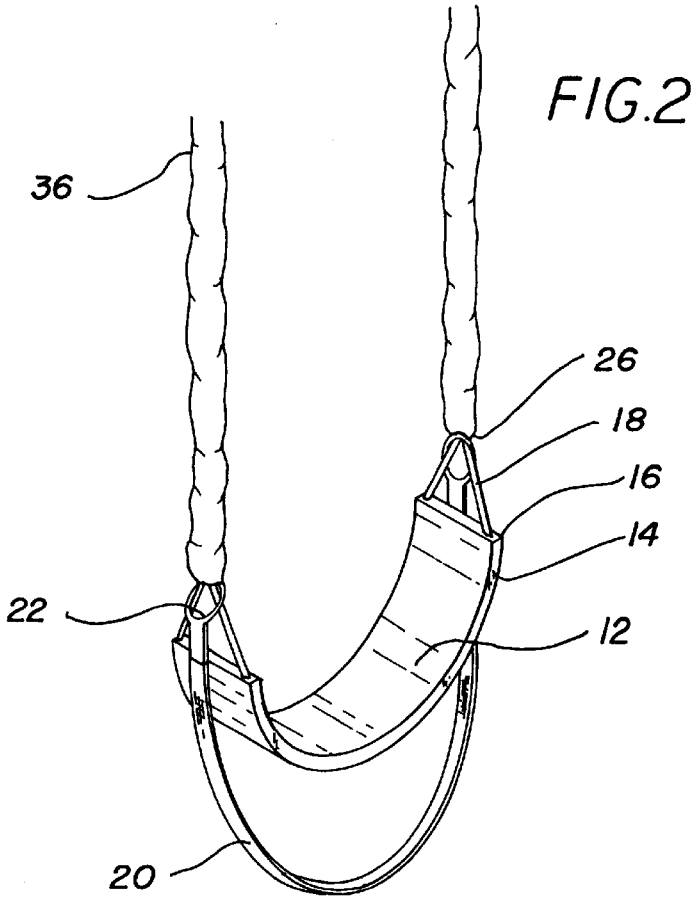
FIG. 2 is a plan perspective view of the flexible seat and foot strap of the present invention.

With reference now to the drawings, and in particular to FIGS. 1 through 4 thereof, a new bungee swing embodying the principles and concepts of the present invention and generally designated by the reference numeral 10 will be described.

As best illustrated in FIGS. 1 through 4, the bungee swing 10 comprises a flexible seat 12 having a generally rectangular configuration. Alternate shapes of seats could also be provided with rectangular being the preferred geometric shape. The seat 12 could be made to accommodate one child or a pair of children. The seat 12 has planar upper and lower surfaces. The seat 12 has opposed long edges 14 and opposed short edges 16. The opposed short edges 16 each have securement straps 18 secured thereto.

A foot strap 20 is coupled with respect to the flexible seat 12. The foot strap 20 has an elongated and generally thin configuration. Opposed ends of the foot strap 20 terminate in loops 22. The loops 22 couple with the securement straps 18 of the flexible seat 12. Note FIG. 2. The foot strap extends below the flexible seat 12 so that the child's feet can rest thereon.

A pair of bungee cords 24 each have lower ends 26 coupled with respect to the flexible seat 12 and upper ends 28 coupled with respect to an upper horizontal bar 30 of a swing set. The lower ends 26 are secured to the securement straps 18 of the flexible seat 12. The upper ends 28 extend through a connecting link 32 and are bent back against the cord 24 and are coupled thereto by a crimping swedge 34. The connecting link 32 has an upper section 36 adapted for coupling with the upper horizontal bar 30 of the swing set. Each of the bungee cords 24 has a cloth casing 36 disposed thereover. Also, each of the cords 24 can be made of up to five bungee strands or more.

In use, the device 10 would bounce up and down as well as swing back and forth and also swing in a circle. The flexible rubber construction of the seat and supports would provide a smooth ride and would be safer than standard swings. This device could be attached to a swing set frame or could be strung on a tree or another support.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bungee swing for providing simultaneous swinging and bouncing comprising, in combination:

a flexible seat having a generally rectangular configuration, the seat having planar upper and lower surfaces, the seat having opposed long edges and opposed short edges, the opposed short edges each having securement straps secured thereto;

a foot strap coupled with respect to the flexible seat, the foot strap having an elongated and generally thin configuration, opposed ends of the foot strap terminating in loops, the loops coupling with the securement straps of the flexible seat; and a pair of bungee cords each having lower ends coupled with respect to the flexible seat and upper ends coupled with respect to an upper horizontal bar of a swing set, the lower ends secured to the securement straps of the flexible seat, the upper ends extending through a connecting link and bent back against the cord and is coupled thereto by a crimping swedge, the connecting link having an upper section adapted for coupling with the upper horizontal bar of the swing set, each of the bungee cords having a cloth casing disposed thereover;

each of the bungee cords being resiliently deformable such that the bungee cord is positionable between a relaxed and an extended position, wherein a length of each of the bungee cords between the ends thereof in the extended position is about twice that of a length of the bungee cord when the bungee cord is in the relaxed position; and wherein each of the bungee cords has at least five bungee strands.

2. A bungee swing comprising:

a flexible seat;

a pair of bungee cords each having lower ends coupled with respect to the flexible seat and upper ends coupled with respect to an elevated overhang; and each of the bungee cords being resiliently deformable such that the bungee cord is positionable between a relaxed and an extended position, wherein a length of each of the bungee cords between the ends thereof in the extended position is about twice that of a length of the bungee cord when in the relaxed position.

3. The bungee swing as set forth in claim 2 and further including a foot strap coupled with respect to the flexible seat, the foot strap having an elongated and generally thin configuration.

4. The bungee swing as set forth in claim 3 wherein the flexible seat has opposed short edges each having securement straps secured thereto, opposed ends of the foot strap terminating in loops, the loops coupling with the securement straps of the flexible seat.

5. The bungee swing as set forth in claim 4 wherein the the lower ends of the bungee cords are secured to the securement straps of the flexible seat.

6. The bungee swing as set forth in claim 5 wherein the upper ends of the bungee cords extend through a connecting link and are bent back against the cord and are coupled thereto by a crimping swedge, the connecting link having an upper section adapted for coupling with the elevated overhang.

7. The bungee cord as set forth in claim 6 wherein each of the bungee cords has a cloth casing disposed thereover.

8. The bungee swing as set forth in claim 2 wherein each of the bungee cords has at least five bungee strands.

* * * * *